US006030065A

United States Patent [19]

Fukuhata

[11] Patent Number: 6,030,065

[45] Date of Patent: Feb. 29, 2000

[54] PRINTING HEAD AND INKJET PRINTER

[75] Inventor: Yoshihiro Fukuhata, Takarazuka, Japan

[73] Assignee: Minolta Co., Ltd., Osaka, Japan

[21] Appl. No.: 08/985,101

[22] Filed: Dec. 4, 1997

[30] Foreign Application Priority Data

Dec. 12, 1996 [JP] Japan ..... 8-331829

[51] Int. Cl.[7] ..... B41J 2/205

[52] U.S. Cl. ..... 347/15; 347/57

[58] Field of Search ..... 347/15, 11, 10, 347/9, 56, 57, 61, 54, 43

[56] References Cited

U.S. PATENT DOCUMENTS

| | | | |
|---|---|---|---|
| 4,369,455 | 1/1983 | McConica et al. | 347/11 |
| 4,503,444 | 3/1985 | Tacklind | 347/15 |
| 4,746,935 | 5/1988 | Allen | 347/15 |
| 5,208,605 | 5/1993 | Drake | 347/15 |
| 5,412,410 | 5/1995 | Rezanka | 347/15 |

FOREIGN PATENT DOCUMENTS 0437062 7/1991 European Pat. Off. .

*Primary Examiner*—John Barlow
*Assistant Examiner*—Juanita Stephens
*Attorney, Agent, or Firm*—Sidley & Austin

[57] ABSTRACT

A printing head for an inkjet printer having two head sections, each featuring discharge nozzles, the two head sections being capable of discharging variable size ink drops to form varying printed dot diameters. One of the head sections has a first dot diameter range, and other head section has a second dot diameter range. A portion of the second dot diameter range overlaps the first dot diameter range. For gradation printing, the head sections of the printing head can be controlled to print an image utilizing the respective dot diameter ranges for each head section; however, for text printing, the head sections of the printing head are controlled to print an image utilizing the overlapping portion of the two dot diameter ranges. The printing head is capable of both high-quality, high-definition gradation printing as well as high-speed text printing.

32 Claims, 5 Drawing Sheets

PRINTING HEAD AND INKJET PRINTER

FIELD OF THE INVENTION

The present invention relates to a printing head and an inkjet printer for printing an image, and in particular, to a printing head and an inkjet printer for printing an image by discharging ink drops from a plurality of nozzles according to an image signal and making the ink drops adhere to a printing medium.

BACKGROUND OF THE INVENTION

Conventionally, there are known printing heads which discharge ink drops from a plurality of nozzles to a printing medium to form an image comprised of a plurality of printed ink dots. In order to form a high-definition, high-quality gradation image by a printing head of this kind, it is necessary to vary the printed ink dot diameter over a range of sizes by changing the size of the ink drops discharged from the printing head.

Interestingly, there exists a growing perception that nozzles of known printing heads have an upper limit and a lower limit with regard to the size of an ink drop which can be stably discharged therefrom. Consequently, there has been proposed a printing head having at least one small diameter nozzle, which discharges a small ink drop, for the formation of an ink dot in a small area and a large diameter nozzle, which discharges an ink drop larger than that of the small nozzle, for the formation of an ink dot in a large area. Examples of such a printing head are disclosed in U.S. Pat. No. 5,208,605 and U.S. Pat. No. 5,412,410.

Today's printers are commonly required to perform both gradation printing as well as text printing. Gradation printing is the printing of images which require gradational expression, while text printing consists of those images requiring no gradation expression, for example, common text and line drawings. While gradation printing utilizes particular dot arrangements and varied dot diameters to form images, text printing requires neither the level of detail required for gradation printing nor a variation in the size of printed dot diameters used to form the "text" images. Rather, high-speed text printing forms images using largely a single printed dot diameter.

SUMMARY OF THE INVENTION

An object of the present invention is to enable high-speed text printing in a printing head capable of printing a high-definition, high-quality gradation image. In order to achieve such object, a printing head of the present invention comprises a first head portion, having a first nozzle, to discharge an ink drop on a printing medium to form a printed first dot diameter and a second head portion, having a second nozzle, to discharge an ink drop on a printing medium to form a printed second dot diameter. While the first head portion can vary the size of a discharged ink drop to form a first dot diameter within a first diameter range, the second head portion can also vary the size of a discharged ink drop to form a second dot diameter within a second diameter range. The second diameter range partially overlaps the first diameter range.

Further, an inkjet printer of the present invention may comprise a printing head, having a first nozzle capable of changing a dot diameter within a specified range on a printing medium by varying the size of an ink drop to be discharged and a second nozzle capable of changing a dot diameter within a specified range, this range partially overlapping the specified range of the first nozzle, by varying the size of an ink drop to be discharged, and a control means for controlling the printing head so that printing is executed in a region in which the dot diameter variable ranges of the nozzles overlap each other when executing text printing. In contrast, when printing a gradation image, said controller controls the printing head so that ink drops of different sizes are appropriately discharged from the first and second nozzles according to an image signal, and a high-definition, high-quality gradation image is formed by combining ink dots of different sizes formed on a printing medium.

As set forth above, the first and second nozzles have partially overlapped variable dot diameter ranges. When executing text printing by means of the aforementioned printing head, such subject matter can be printed with ink dots of a specified size within the overlapping variable dot diameter ranges, wherein ink dots of an approximately identical diameter are produced by the two nozzles. Therefore, the travel speed of the printing head of the present invention, relative to the printing medium, can be increased over conventional printing heads which would conduct text printing, for example, with only one of two available nozzles, thus allowing high-speed text printing to be enabled.

The first nozzle and the second nozzle of the printing head of the present invention may have different nozzle diameters. In such an embodiment, the ink drops discharged from the nozzles can be varied in size within the respective specified variable dot diameter ranges even though other constructions or supporting components, for example, the mechanism and so forth for ink discharge corresponding to the nozzles, are identical. This embodiment further contributes to a reduction in manufacturing cost for such a printing head.

For another embodiment, a printing head of the present invention has a plurality of first nozzles and a plurality of second nozzles aligned in a direction perpendicular to a direction in which the printing head moves. For yet another embodiment, the plurality of first nozzles and the plurality of second nozzles are arranged in parallel with each other in the above-mentioned perpendicular direction. With regard to the former of the two alternative embodiments, printing a gradation image requires moving the printing head relative to a printing medium so that each first nozzle and corresponding second nozzle are exposed to an identical printing area of the printing medium—as a gradational expression can be achieved by forming ink dots of a variety of different diameters in such printing area. Text printing merely requires, however, forming an image having ink dots of an approximately single, prescribed diameter. Therefore, the area on the printing medium facing the first and second nozzles can be printed by exposure to only a single nozzle (or plurality of like nozzles as the case may be). Therefore, when executing text printing, the travel speed of the printing head, relative to the printing medium, can be increased over when a gradation image is printed, allowing high-speed text printing to be achieved.

Furthermore, where the plurality of first nozzles and the plurality of second nozzles are arranged in parallel in a direction perpendicular to the direction in which the printing head moves and each first nozzle is aligned with a corresponding second nozzle, a double-nozzle density results in the direction in which the printing head moves. In view of the above discussion, a double-nozzle density configuration for text printing allows the travel speed of the printing head to be increased in the direction in which the printing head moves. Alternatively, when each first nozzle is not aligned with a corresponding second nozzle, i.e., the nozzles form a staggered configuration, the travel speed of the head in the aforementioned perpendicular direction can be increased when text printing. Thus, the travel speed of the printing head can be increased for either nozzle configuration, thereby allowing high-speed text printing to be achieved.

In the inkjet printer of the present invention, the control means controls the printing head so as to execute text printing within the overlapping range of the variable dot diameter ranges of the first nozzle and the second nozzle. With this arrangement, text printing of non-gradation subject matter can be executed with ink dots of an approximately identical diameter formed by both of the two nozzles. Therefore, the travel speed of the printing head, relative to the printing medium, can be increased, thereby allowing high-speed text printing to be achieved.

Other objects and advantages of the present invention will be apparent to those of ordinary skill in the art having reference to the following specification together with the drawings.

BRIEF DESCRIPTION OF THE DRAWINGS

Referring now to the drawings in which like reference numerals and letters indicate corresponding elements throughout the several views, if applicable.

DETAILED DESCRIPTION OF THE PREFERRED EMBODIMENTS

Figure 1:
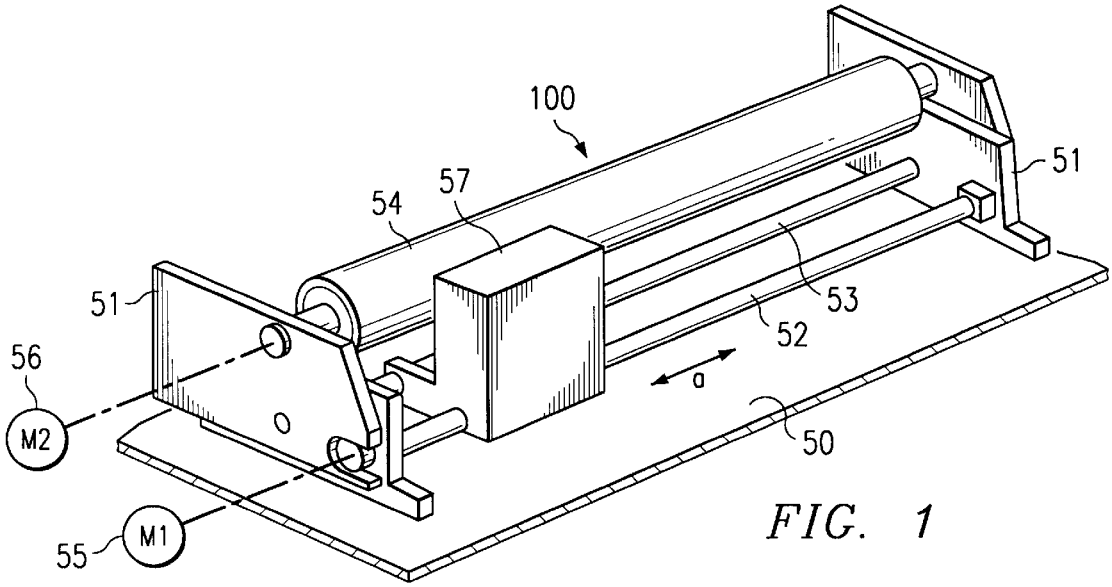
FIG. 1 is a perspective view an inkjet printer of the present invention.
Figure 2:
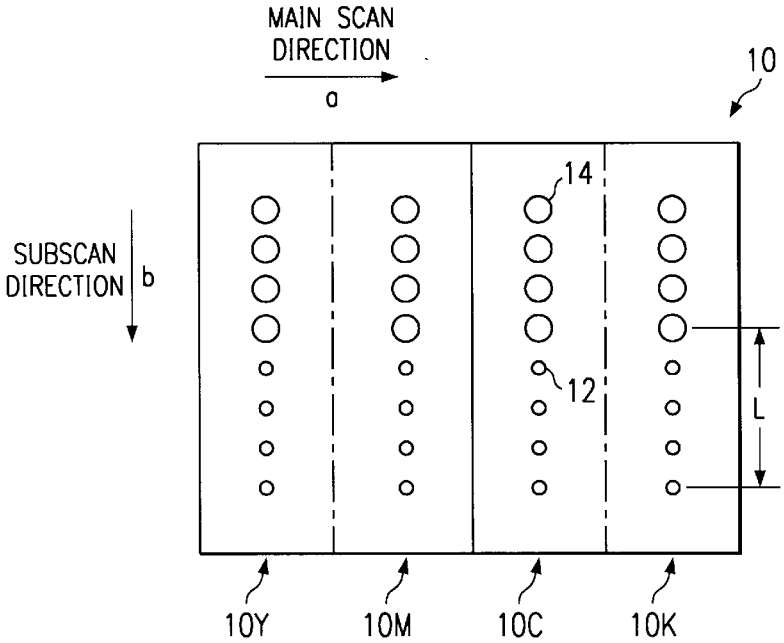
FIG. 2 is a front view of a printing head surface which faces a printing medium according to an embodiment of the present invention.

An embodiment of the present invention will be described below with reference to the accompanying drawings. FIG. 1 is a perspective view of one embodiment of an inkjet printer of the present invention. As shown in FIG. 1, the inkjet printer 100 is provided with a base 50. On the base 50 is provided a pair of side walls 51 which face each other and are located at a specified interval. A backup roller 54, a guide rod 53, and a ball thread 52 are extended in parallel with each other between the side walls 51. The backup roller 54 and the ball thread 52 are each made rotatable, and they are operatively connected to motors 56 and 55, respectively. Further, a carriage 57 is provided so as to be engaged with the guide rod 53 and the ball thread 52.

The carriage 57 has a threaded hole (not shown), and by the combination of this threaded hole and the ball thread 52, the carriage 57 can reciprocate in the direction of arrow "a" (hereinafter referred to as a "main scanning direction") along the guide rod 53 and the ball thread 52, based on the rotation of the ball thread 52. A surface which belongs to the carriage 57 and faces the backup roller 54 is provided with a printing head 10, which will be described later. The printing head 10 discharges onto a printing medium (for example, a paper sheet, a thin, plastic plate (film), or the like), said printing medium being conveyed along the outer peripheral surface of the backup roller 54 in the direction of the periphery, to form an image. In forming an image, the carriage 57 travels at a constant speed in the main scanning direction.

FIGS. 2 through 5 illustrate an embodiment of the printing head 10 provided for the aforementioned inkjet printer 100. The printing head 10 reciprocates in the main scanning direction (i.e., in the direction of arrow a) as the carriage 57 is driven as described above, and a printing medium is conveyed in a sub-scanning direction (i.e, in the direction of arrow b), such sub-scanning direction being perpendicular to the main scanning direction.

The printing head 10 has four head sections 10Y, 10M, 10C and 10K corresponding to different color inks, for example, yellow, magenta, cyan, and black. Each of the head sections 10Y, 10M, 10C, and 10K has a plurality of ink drop discharging nozzles 12 and 14 arranged at a constant pitch and aligned in the sub-scanning direction on a surface facing a printing medium. The nozzle arrays of each head section 10Y, 10M, 10C, and 10K are comprised of a plurality of small-diameter nozzles (or first nozzles) 12 arranged in a lower region of each head section 10Y, 10M, 10C, and 10K and a plurality of large-diameter nozzles (or second nozzles) 14 arranged in an upper region of each head section 10Y, 10M, 10C, and 10K. Further, the head sections 10Y, 10M, 10C, and 10K are arranged in the main scanning direction.

The construction of the head section 10C and the head section 10K will be described below with reference to FIGS. 3 through 5. The head section 10Y and the head section 10M have the same construction, and therefore, no description is provided here. Head sections 10C and 10K are integrally constructed symmetrically about a centerline 34, where the centerline 34 extends in the sub-scanning direction. The head section 10C and the head section 10K are formed by a channel plate 16, a bulkhead 18, a vibration plate 20, and a base plate 22, integrally stacked.

The channel plate 16 is comprised of a flat plate made of a metal, synthetic resin, ceramic, or the like. A surface of channel plate 16, which faces bulkhead 18, is finely finished by electroforming, photolithography or the like, so that a plurality of recesses are formed. These recessions form a plurality of ink channels 26 for storing ink; ink supplying chambers 30 that contain resupply ink; and ink inlets 32 that connect ink channels 26 to ink supplying chambers 30.

Figure 3:
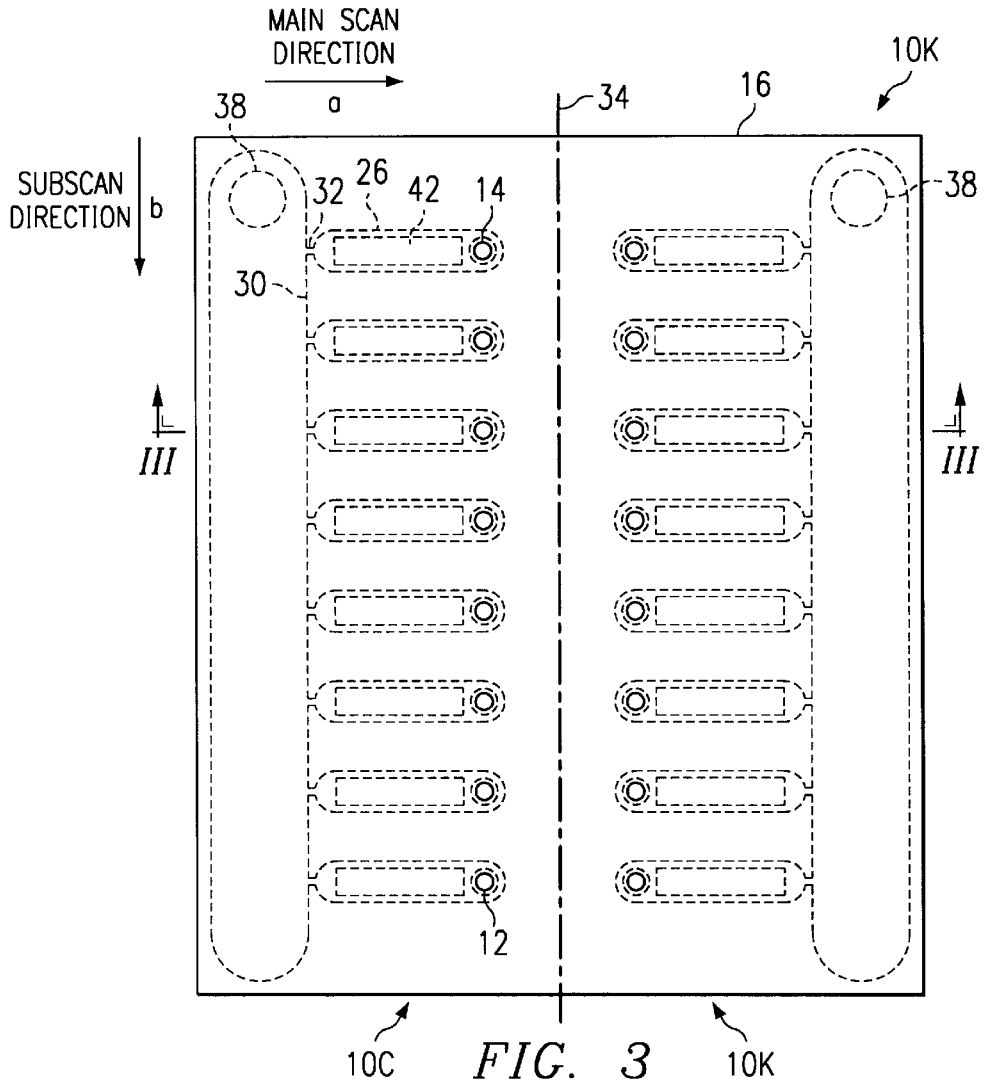
FIG. 3 is an enlarged front view of a head section of the printing head shown in FIG. 2.

As shown in FIG. 3, the ink channels 26, which face each other with interposition of the centerline 34, are elongated in the main scanning direction and are arranged in parallel with each other in the sub-scanning direction. The ink supplying chambers 30 are formed on opposite sides of the centerline 34, with interposition of the ink channels 26, and are each connected to respective ink tanks (not shown) via an ink supply inlet 38. The small-diameter nozzles 12 and the large-diameter nozzles 14 are formed within the channel plate 16 and communicate with each ink channel 26 on an end opposite from ink inlets 32. It is to be noted that the nozzles 12 and 14 are convergently tapered, where the ink channel 26 side-diameter is wider than the exit diameter.

A bulkhead 18 is constructed of a thin film and is fixed between channel plate 16 and vibration plate 20. The bulkhead 18 is constructed of a metal, synthetic resin, or the like. The bulkhead 18 does not prevent the deformation of the piezoelectric members 42, described in greater detail below, but yields to a deformation of the piezoelectric members 42 so as to transmit such deformation to ink channels 26.

Figure 4:
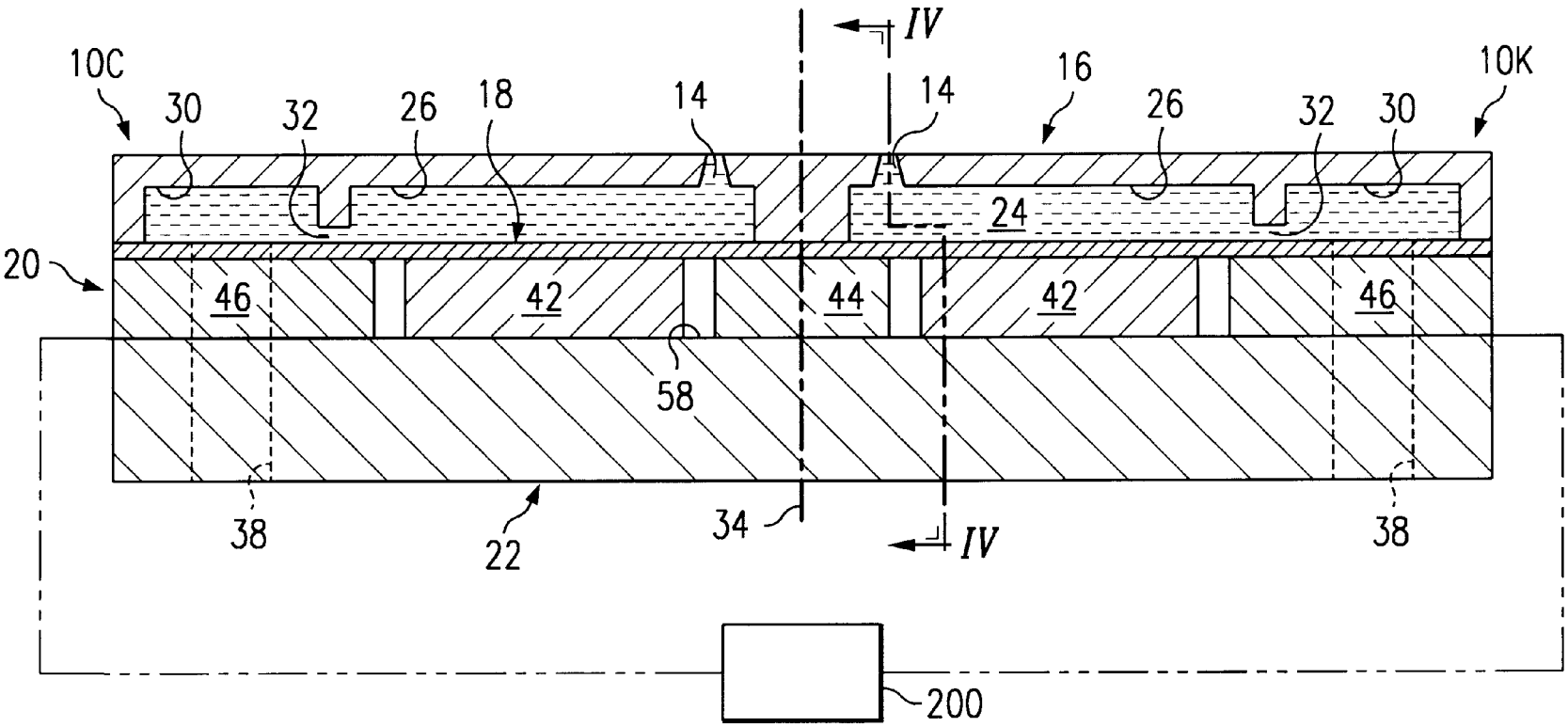
FIG. 4 is a sectional view taken along the line IV—IV of the head section shown in FIG. 3.
Figure 5:
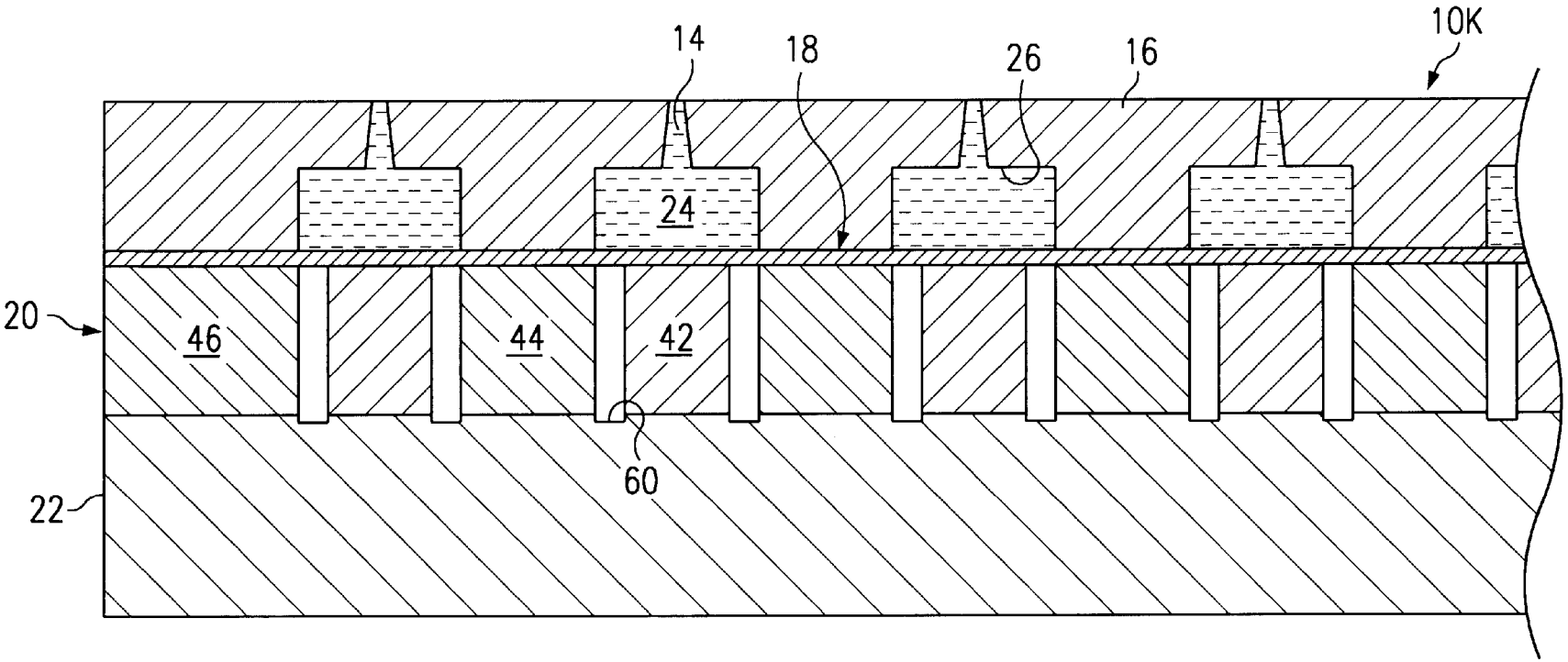
FIG. 5 is a sectional view taken along the line V—V of the head section shown in FIG. 4.

Referring to FIGS. 4 and 5, the vibration plate 20 is fixed between the bulkhead 18 and the base plate 22. The vibration plate 20 is made of a known piezoelectric material, and its upper and lower surfaces are provided with conductive metal layers (not shown). Prior to bulkhead 11 being fixed in place, the vibration plate 20 is cut longitudinally (longitudinal grooves 58) and laterally (lateral grooves 60) in a dicing process, such that the vibration plate 20 is separated into piezoelectric members 42 corresponding to each ink channel 26; partition walls 44 positioned between adjacent piezoelectric members 42; and peripheral walls 46 which encloses these members. The dicing process serves to also divide the conductive metal layers formed on the upper and lower surfaces of vibration plate 20. The conductive metal layers on the upper surfaces of piezoelectric members 42 form a common electrode and the corresponding metal conductive layers on the lower surface form individual electrodes. Each piezoelectric member 42 can be polarized by applying a high voltage across the upper common electrode and the lower individual electrode at an elevated temperature.

The common electrode of each piezoelectric member 42 is connected to ground, while the individual electrodes of each piezoelectric member 42 is connected to an image signal control circuit 200. This image signal control circuit 200 can vary the drive voltage applied to each piezoelectric member 42. While the piezoelectric member 42 is of a single-layer type for the above embodiment, it is acceptable to use a laminate type piezoelectric member (not shown) formed by laminating a plurality of thin film piezoelectric sheets having alternately interposed metal electrode layers between them.

The base plate 22 is made of a ceramic, metal, synthetic resin or the like, and the vibration plate 20 is fixed and supported on its upper surface.

An ink drop discharging operation and a printing operation by the printing head 10 having the aforementioned construction will be described next. In the printing head 10 of this embodiment, the inks of yellow, magenta, cyan, and black are supplied from respective ink tanks (not shown) to ink supply chambers 30 and then the ink supply inlets 32 of the head sections 10Y, 10M, 10C, and 10K, respectively, so that the inks of different colors are stored in the ink channels 26 of the head sections 10Y, 10M, 10C, and 10K. When a voltage is applied from the image signal control circuit 200 to a piezoelectric member 42, the piezoelectric member 42 is instantaneously deformed to press the bulkhead 18 against a corresponding ink channel 26. By this operation, ink inside the ink channel 26 is pressurized, and an ink drop is discharged from either the small-diameter nozzles 12 or the large-diameter nozzles 14. When the drive voltage applied to the piezoelectric member 42 by the image signal control circuit 200 is varied, the amount of deformation of the piezoelectric member 42 is increased or decreased. Consequently, in accordance with the change of deformation, a pressure force exerted on the ink within the ink channel 26 varies, thus changing the size of a discharged ink drop.

For a printing head 10 of the above embodiment, a drive voltage applied to a piezoelectric member 42 was varied and the diameters of ink dots formed on a printing medium by the ink drops discharged from the small-diameter nozzle 12 and the large-diameter nozzle 14 were measured to determine representative printed dot diameter variation. For such evaluation, the small-diameter nozzle 12 had an exit diameter (d) of approximately 35 $\mu$m and the large-diameter nozzle 14 had an exit diameter (d) of approximately 50 $\mu$m. Varying the drive voltage applied to the piezoelectric member 42 from 10 V to 60 V in steps of 10 V produced printed dot diameters as shown in FIG. 6.

Figure 6:
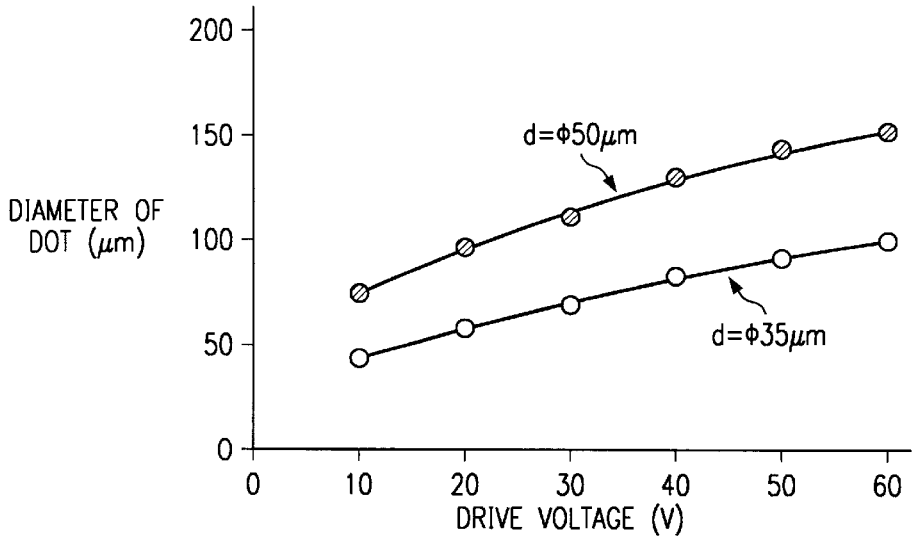
FIG. 6 is a graph showing a change in printed dot diameters formed by a small-diameter nozzle and a large-diameter nozzle of a printing head of the present invention as a result of varying an applied drive voltage.

As shown in FIG. 6, ink dots having a diameter of about 40 to 100 $\mu$m were formed by the small-diameter nozzle 12, and ink dots having a diameter of about 70 to 150 $\mu$m were formed by the large-diameter nozzle 14. Therefore, for this specific embodiment, the variable dot diameter ranges for the nozzles 12 and 14 partially overlap between 70 and 100 $\mu$m. The printing head 10 of this specific embodiment has a variable dot diameter range of 40 to 150 $\mu$m as a whole.

When printing a color gradation image by means of the aforementioned printing head 10, ink drops are first discharged from the small-diameter nozzles 12 of each appropriate head section while moving the printing head 10 in the main scanning direction, thereby forming small-diameter ink dots (for example, 30 to 90 $\mu$m) in a belt-shaped area on the printing medium. In this stage, drive voltages corresponding to the densities of the image to be printed are applied to the piezoelectric members 42 corresponding to the small-diameter nozzles 12. The ink drops discharged from the small-diameter nozzles 12 are controlled in size according to the densities of the image to be printed, and ink dots having a relatively small diameter are thus formed on the printing medium. Subsequently, when forming large-diameter ink dots in the belt-shaped area in the same main scanning direction as that of the earlier-formed small-diameter ink dots, the printing medium is conveyed in the sub-scanning direction by a distance L (corresponding to a distance between the centers of the small-diameter nozzles 12 and the large-diameter nozzles 14 in the sub-scanning direction, refer to FIG. 2) relative to the printing head 10, wherein the large-diameter nozzles 14 are made to face the aforementioned belt-shaped area in which the small-diameter ink dots have been already formed. Then, ink drops are discharged from the large-diameter nozzles 14 of each applicable head section while moving the printing head 10 in the main scanning direction, thereby forming relatively large-diameter ink dots (for example, 100 to 150 $\mu$m) in the same belt-shaped area on the printing medium. In this stage, similar to the case of the aforementioned small-diameter nozzles 12, drive voltages corresponding to the densities of the image to be printed are applied to the piezoelectric members 42 corresponding to the large-diameter nozzles 14, wherein the ink drops discharged from the large-diameter nozzles 14 are controlled in size according to the densities of the image to be printed, and ink dots having a relatively large diameter are thus formed on the printing medium. By appropriately combining a variety of ink dots having different colors and sizes on the printing medium, a high-definition, high-quality color gradation image can be printed.

In the present embodiment, the image can be printed in six level gradation. That is, a dot having a density of gradation level 1 is formed from a printed ink dot having a diameter of approximately 40 $\mu$m; a dot having a density of gradation level 2 is formed from a printed ink dot having a diameter of approximately 62 $\mu$m; a dot having a density of gradation level 3 is formed from a printed ink dot having a diameter of approximately 84 $\mu$m; a dot having a density of gradation level 4 is formed from a printed ink dot having a diameter of approximately 106 μm; a dot having a density of gradation level 5 is formed from a printed ink dot having a diameter of approximately 128 μm; and a dot having a density of gradation level 6 is formed from a printed ink dot having a diameter of approximately 150 μm. Therefore, the dots of gradation levels 1 through 3 can be printed by the small-diameter nozzles 12, and the dots of the gradation levels 4 through 6 can be printed by the large-diameter nozzles 14.

It is to be noted that the small-diameter nozzle 12 and the large-diameter nozzle 14 are capable of providing ink dots having like dot diameters within a dot diameter range of 70 to 100 μm. That is, in terms of the gradation level, gradation level 3 can be printed by either the small-diameter nozzle 12 or the large-diameter nozzle 14. However, the present invention is not limited to this, wherein the nature of the present invention is such that the range of the dot diameters which can be printed by the small-diameter nozzle 12 and the large-diameter nozzle 14 should overlap at least one gradation level without overlapping either the maximum gradation level (for example, gradation level 6) or the minimum gradation level (for example, gradation level 1).

When executing text printing with one color of ink (normally, black ink) by means of the aforementioned printing head 10, there exists neither the need for the level of detail required for a gradation image nor a variation in the size of the ink dot used to form the image. Therefore, it is proper to execute a print operation with ink dots of a specified size in the range in which the variable dot diameter ranges of the small-diameter nozzles 12 and the large-diameter nozzles 14 overlap. Specifically, based on the measurement results shown in FIG. 6, for example, a drive voltage of 60 V is applied to the piezoelectric members 42 corresponding to the small-diameter nozzles 12, and a drive voltage of 20 V is applied to the piezoelectric members 42 corresponding to the large-diameter nozzles 14, thereby forming ink dots of approximately 100 μm diameter by both the nozzles 12 and 14. In this case, the belt-shaped areas on the printing medium facing the small-diameter nozzles 12 and the large-diameter nozzles 14 can be printed one at a time by the printing head 10 traveling only one time in the main scanning direction. Therefore, the distance of printing medium conveyance per time in the sub-scanning direction following printing is 2L. That is, the conveyance speed of the printing medium in the sub-scanning direction for text printing can be about double that of printing a gradation image, thereby allowing the printing speed to be increased. If the time required for processing image data for text printing is shorter than that of the gradation image is taken into consideration, the text printing speed is further increased.

As apparent from the above description, according to the printing head 10 of the present embodiment, a high-definition, high-quality color gradation image printing and a high-speed text printing can be achieved. Furthermore, the head sections of the printing head 10 have an identical construction except that the exit diameters of the small-diameter nozzles 12 and the large-diameter nozzles 14 are different. This arrangement allows reduction in manufacturing cost, and therefore, the aforementioned two types of printing can be easily achieved by a relatively less expensive printing head, as described above.

Figure 7:
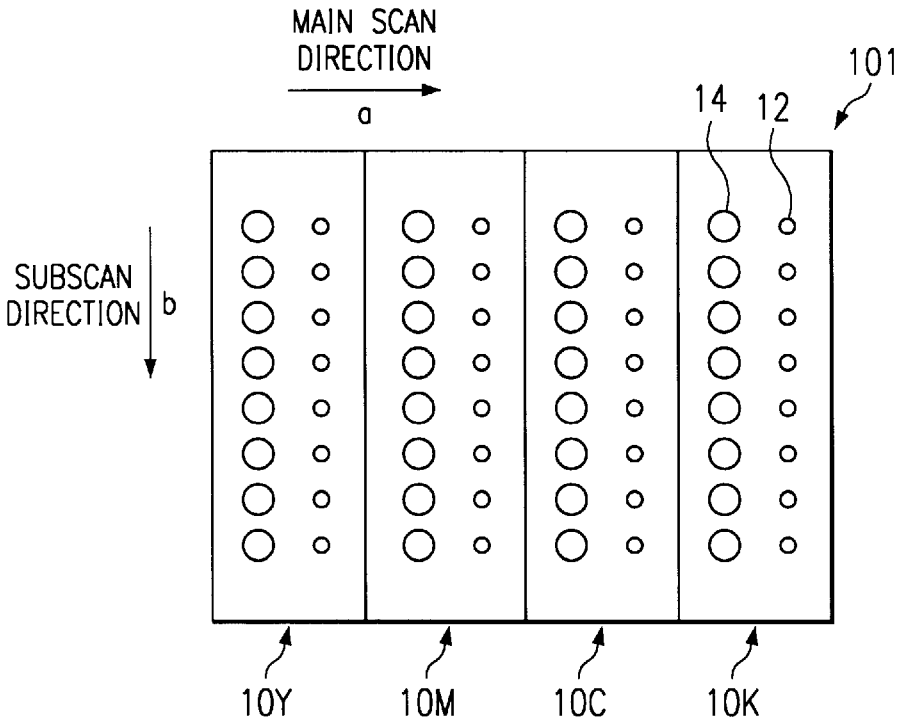
FIG. 7 is a front view showing a printing head having a different nozzle arrangement in accordance with another embodiment of the present invention.

A printing head 10 of another embodiment will be described next; however, no description is provided for the construction other than that of the nozzle array arrangements since the construction is otherwise the same as that of the aforementioned printing head 10. Referring to FIG. 7, printing head 101 has a plurality of small-diameter nozzles 12 and a plurality of large-diameter nozzles 14 arranged in parallel, with each nozzle size alternately positioned in the main scanning direction for each of the head sections 10Y, 10M, 10C, and 10K. When text printing is executed by the printing head 101, the travel speed of the printing head 101 in the sub-scanning direction is equal to that for printing a gradation image. However, since the small-diameter nozzles 12 and the large-diameter nozzles 14 are arranged so that they are aligned in the main scanning direction, a doubled-nozzle density is achieved in the main scanning direction when text printing. Therefore, when ink dots of an approximately identical diameter are formed by the nozzles 12 and 14, the travel speed of the printing head 101 in the main scanning direction for text printing can be made to be about double that for printing a gradation image.

Figure 8:
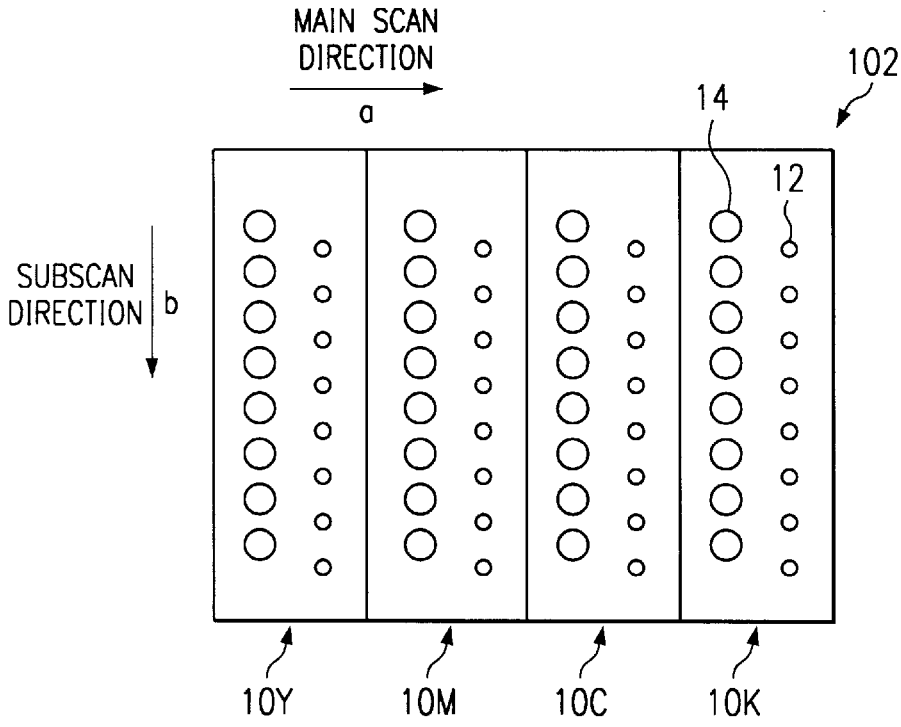
FIG. 8 is a front view showing a printing head having a different nozzle arrangement in accordance with yet another embodiment of the present invention.

Referring to FIG. 8, printing head 102 of another embodiment has a plurality of small-diameter nozzles 12 and a plurality of large-diameter nozzles 14 arranged in parallel with each other in the main scanning direction similar to the aforementioned printing head 101. However, the nozzles 12 and 14 have a staggered arrangement so that the small-diameter nozzles 12 are positioned between the large-diameter nozzles 14 in the sub-scanning direction. For printing head 102, the density of the nozzles in the sub-scanning direction capable of forming ink dots of an approximately identical diameter is doubled, and therefore, the travel speed of the printing head 102 in the sub-scanning direction when text printing is executed can be increased.

Although the printing heads of the aforementioned embodiments have been described as a color printing head, provided with head sections corresponding to specific ink colors, the present invention can also be applied to a mono-color printing head.

Although the head section 10K can be utilized to form images requiring black ink, images requiring black ink may also be expressed by superposing yellow, magenta, and cyan inks. Therefore, printing may be executed by driving the head sections 10Y, 10M, and 10C of yellow, magenta, and cyan inks, respectively, in addition to (or in lieu of) the head section 10K. For text printing, the small-diameter nozzles 12 and large-diameter nozzles 14 for each of the head sections 10Y, 10M, and 10C are used to form ink dots having a dot diameter within an overlapping portion of the variable dot diameter ranges for nozzles 12 and 14. Accordingly, the three head sections 10Y, 10M, and 10C of yellow, magenta, and cyan inks, respectively, operate similarly to the head section 10K, and therefore, the printing speed is double that of head section 10K when used alone.

Although the inkjet printer 100 employing a piezoelectric member 42 has been used as an example above, the means for pressurizing the ink for discharge is not limited to the aforementioned one, and a variety of conventionally known means can be used. The present invention can be applied to, for example, a thermal inkjet printer employing a heat generating element.

Although in the above embodiments, the small-diameter ink dot and the large-diameter ink dot are formed by varying the nozzle diameter from nozzles 12 and nozzles 14, it is also acceptable to form the dots by varying other factors while maintaining an identical nozzle diameter for nozzles 12 and 14. For example, the ink dot diameter can be varied by varying the lengths of the ink channels 26 and the piezoelectric members 42, varying the thickness of each piezoelectric member 42 in the direction in which it faces the ink channel 26, combining these schemes with the variation of the nozzle diameters, or any other approach apparent to one ordinarily skilled in the art.

While the invention has been described herein relative to a number of particularized embodiments, it is understood that modifications of, and alternatives to, these embodiments, such modifications and alternatives realizing the advantages and benefits of this invention, will be apparent to those of ordinary skill in the art having reference to this specification and its drawings. It is contemplated that such modifications and alternatives are within the scope of this invention as subsequently claimed herein, and it is intended that the scope of this invention claimed herein be limited only by the broadest interpretation of the appended claims to which the inventors are legally entitled.

What is claimed is:

1. A printing head for a printing apparatus comprising:

a first head portion, having a first nozzle, to discharge an ink drop on a printing medium to form a printed first dot diameter, said first head portion can vary a size of a discharged ink drop to form the printed first dot diameter within a first diameter range; and a second head portion, having a second nozzle, to discharge an ink drop on a printing medium to form a printed second dot diameter, said second head portion can vary a size of a discharged ink drop to form the printed second dot diameter within a second diameter range, wherein said second diameter range differs from said first diameter range but includes a portion that overlaps with said first diameter range.

2. The printing head as claimed in claim 1, wherein said first nozzle and said second nozzle have different nozzle diameters.

3. The printing head as claimed in claim 1, wherein said first nozzle and said second nozzle have substantially equivalent nozzle diameters.

4. The printing head as claimed in claim 1, wherein said first nozzle is parallel to said second nozzle.

5. The printing head as claimed in claim 4, wherein said first nozzle is aligned with said second nozzle in a direction perpendicular to a direction in which said printing head moves.

6. The printing head as claimed in claim 4, wherein said first nozzle is aligned with said second nozzle in a direction in which said printing head moves.

7. The printing head as claimed in claim 4, wherein said first nozzle and said second nozzle are unaligned, said second nozzle being offset with respect to said first nozzle in a direction perpendicular to a direction in which said printing head moves.

8. The printing head as claimed in claim 1, wherein said first head portion includes a plurality of first nozzles and said second head portion includes a corresponding plurality of second nozzles.

9. An inkjet printer, comprising:

a printing head having, a first head portion, having a first nozzle, to discharge an ink drop on a printing medium to form a printed first dot diameter, said first head portion can vary a size of a discharged ink drop to form the printed first dot diameter within a first diameter range, and a second head portion, having a second nozzle, to discharge an ink drop on a printing medium to form a printed second dot diameter, said second head portion can vary a size of a discharged ink drop to form the printed second dot diameter within a second diameter range; and a control means for controlling said printing head so that said first head portion and said second head portion print to a region on a printing medium, wherein said second diameter range partially overlaps the first diameter range, and wherein for text printing, said first dot diameter and said second dot diameter are within an overlapping portion of said first diameter range and said second diameter range.

10. The inkjet printer as claimed in claim 9, wherein said first nozzle and said second nozzle have different nozzle diameters.

11. The inkjet printer as claimed in claim 9, wherein said first nozzle and said second nozzle have substantially equivalent nozzle diameters.

12. The inkjet printer as claimed in claim 9, wherein said first nozzle is parallel to said second nozzle.

13. The inkjet printer as claimed in claim 12, wherein said first nozzle is aligned with said second nozzle in a direction perpendicular to a direction in which said printing head moves.

14. The inkjet printer as claimed in claim 12, wherein said first nozzle is aligned with said second nozzle in a direction in which said printing head moves.

15. The inkjet printer as claimed in claim 12, wherein said first nozzle and said second nozzle are unaligned, said second nozzle being offset with respect to said first nozzle in a direction perpendicular to a direction in which said printing head moves.

16. The inkjet printer as claimed in claim 12, wherein the first diameter range is approximately 40 to 100 $\mu$m and the second diameter range is approximately 70 to 150 $\mu$m, wherein the overlapping portion is approximately 70 to 100 $\mu$m.

17. The printing head as claimed in claim 9, wherein said first head portion includes a plurality of first nozzles and said second head portion includes a corresponding plurality of second nozzles.

18. An inkjet printer for printing an image, comprising:

a first printing head for printing a non-black color ink and being capable of discharging a variable size ink drop to form a printed dot having a diameter within a variable range;

a second printing head for printing a substantially black color ink and being capable of discharging a variable size ink drop to form a printed dot having a diameter within said variable range;

a controller for controlling a print operation, including a size of ink drops discharged from said first printing head and said second printing head, wherein, for printing a non-gradational image, ink drops discharged from either said first printing head or said second printing head are of an approximately identical size.

19. The inkjet printer as claimed in claim 18, wherein the first printing head has a first head portion, having a first nozzle, which can vary a size of a discharged ink drop to form a printed dot within a first diameter range, said first diameter range being a lower portion of said variable range, and a second head portion, having a first nozzle, which can vary a size of a discharged ink drop to form a printed dot within a second diameter range, said second diameter range being an upper portion of said variable range, wherein said second diameter range partially overlaps the first diameter range.

20. The inkjet printer as claimed in claim 19, wherein said first nozzle and said second nozzle have different nozzle diameters.

21. The inkjet printer as claimed in claim 19, wherein said first nozzle and said second nozzle have substantially equivalent nozzle diameters.

22. The inkjet printer as claimed in claim 18, wherein the second printing head has a first head portion, having a first nozzle, which can vary a size of a discharged ink drop to form a printed dot within a first diameter range, said first diameter range being a lower portion of said variable range, and a second head portion, having a first nozzle, which can vary a size of a discharged ink drop to form a printed dot within a second diameter range, said second diameter range being an upper portion of said variable range, wherein said second diameter range partially overlaps the first diameter range.

23. The inkjet printer as claimed in claim 22, wherein said first nozzle and said second nozzle of said second printing head have different nozzle diameters.

24. The inkjet printer as claimed in claim 22, wherein said first nozzle and said second nozzle of said second printing head have substantially equivalent nozzle diameters.

25. A method of printing using an inkjet printer, the steps comprising:

generating a control signal in accordance with image data to be printed; and controlling a printing head to print an image on a printing medium in accordance with said control signal, wherein said printing head comprises:

a first head portion, having a first nozzle, to discharge an ink drop on a printing medium to form a printed first dot diameter, said first head portion can vary a size of a discharged ink drop subject to said control signal to form the printed first dot diameter within a first diameter range; and a second head portion, having a second nozzle, to discharge an ink drop on a printing medium to form a printed second dot diameter, said second head portion can vary a size of a discharged ink drop subject to said control signal to form the printed second dot diameter within a second diameter range, wherein said second diameter range partially overlaps the first diameter range.

26. The method as claimed in claim 25, wherein the image requires gradational expression, said step of controlling said printing head allows the discharge of ink drops having a size within a full diameter range, said full diameter range consisting of said first diameter range and said second diameter range.

27. The method as claimed in claim 25, wherein the image does not require gradational expression, said step of controlling said printing head includes the discharge of ink drops having an approximately identical size from both said first nozzle and said second nozzle, said approximately identical size being within the second diameter range which partially overlaps said first range.

28. The method as claimed in claim 27, wherein said first nozzle is parallel to said second nozzle.

29. The method as claimed in claim 28, wherein said first nozzle is aligned with said second nozzle in a direction perpendicular to a direction in which said printing head moves, said first nozzle being positioned apart from said second nozzle by a center-to-center distance of L.

30. The method as claimed in claim 29, wherein said step of controlling said printing head further comprises:

moving said printing head along the printing medium to print a line of said image; and upon reaching an end of said line, advancing said the printing medium a distance equal to at least 2L.

31. The method as claimed in claim 28, wherein said first nozzle is aligned with said second nozzle in a direction in which said printing head moves.

32. The method as claimed in claim 31, wherein said first nozzle and said second nozzle are unaligned, said second nozzle being offset with respect to said first nozzle in a direction perpendicular to a direction in which said printing head moves.

* * * * *